US006575240B1

(12) United States Patent
Cook et al.

(10) Patent No.: US 6,575,240 B1
(45) Date of Patent: Jun. 10, 2003

(54) SYSTEM AND METHOD FOR DRIVING PIPE

(75) Inventors: Robert Lance Cook, Katy, TX (US); Richard Carl Haut, Sugar Land, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/511,941

(22) Filed: Feb. 24, 2000

Related U.S. Application Data

(63) Continuation-in-part of application No. 09/454,139, filed on Dec. 3, 1999.

(60) Provisional application No. 60/121,907, filed on Feb. 26, 1999, and provisional application No. 60/111,293, filed on Dec. 7, 1998.

(51) Int. Cl.[7] ..... E21B 23/00; E21B 43/10; E02D 5/22

(52) U.S. Cl. ..... 166/207; 166/206; 166/212; 166/217; 166/380; 175/22; 175/171; 405/224; 405/228; 405/231

(58) Field of Search ..... 166/206, 211, 166/207, 217, 212, 216, 85.1, 177.4, 375, 380; 175/22, 23, 19, 171; 405/224, 238, 249, 225, 231

(56) References Cited

U.S. PATENT DOCUMENTS

| | | | |
|---|---|---|---|
| 46,818 A | 3/1865 | Patterson | |
| 341,237 A | 5/1886 | Healey | |
| 958,517 A | 5/1910 | Mettler | |
| 984,449 A | 2/1911 | Stewart | |
| 1,233,888 A | 7/1917 | Leonard | |
| 1,589,781 A | 6/1926 | Anderson | |
| 1,590,357 A | 6/1926 | Feisthamel | |
| 1,880,218 A | 10/1932 | Simmons | |
| 1,981,525 A | 11/1934 | Price | |
| 2,046,870 A | 7/1936 | Clasen et al. | |

(List continued on next page.)

FOREIGN PATENT DOCUMENTS

| | | | |
|---|---|---|---|
| CA | 736288 | 6/1966 | ..... 166/16 |
| CA | 771462 | 11/1967 | ..... 166/16 |
| CA | 1171310 | 7/1984 | ..... F16B/13/06 |
| DE | 203767 | 11/1983 | ..... E21B/43/10 |
| DE | 233607 | 3/1986 | ..... E21B/17/00 |
| DE | 278517 | 5/1990 | ..... B21D/28/28 |
| EP | 633391 A2 * | 1/1995 | ..... 166/206 |
| EP | 0713953 B1 | 11/1995 | |

(List continued on next page.)

OTHER PUBLICATIONS

Search Report to Application No. GB 0003251.6, Claims Searched 1–5, Jul. 13, 2000.

Search Report to Application No. GB 0004285.3, Claims Searched 2–3, 8–9, 13–16, Jan. 17, 2001.

Search Report to Application No. GB 005399.1, Claims Searched 25–29, Feb. 15, 2001.

Search Report to Application No. GB 9930398.4, Claims Searched 1–35, Jun 27, 2000.

International Search Report, Application No. PCT/US00/30022, Oct. 31, 2000.

International Search Report, Application No. PCT/US01/19014, Jun. 12, 2001.

*Primary Examiner*—Heather Shackelford
*Assistant Examiner*—Jong Lee
(74) *Attorney, Agent, or Firm*—Haynes and Boone, LLP; Todd Mattingly

(57) ABSTRACT

An apparatus and method for forming a wellbore casing. A mandrel is used to position a tubular member within a wellbore. The mandrel is then driven into the bottom of the wellbore. The tubular member is then radially expanded by the mandrel.

20 Claims, 9 Drawing Sheets

U.S. PATENT DOCUMENTS

| | | | | | |
|---|---|---|---|---|---|
| 2,187,275 | A | | 1/1940 | McLennan | |
| 2,204,586 | A | | 6/1940 | Grau | |
| 2,214,226 | A | | 9/1940 | English | |
| 2,226,804 | A | | 12/1940 | Carroll | |
| 2,447,629 | A | | 8/1948 | Beissinger et al. | |
| 2,500,276 | A | | 3/1950 | Church | |
| 2,583,316 | A | | 1/1952 | Bannister | |
| 2,734,580 | A | | 2/1956 | Layne | |
| 2,796,134 | A | | 6/1957 | Binkley | |
| 2,812,025 | A | | 11/1957 | Teague et al. | |
| 2,907,589 | A | | 10/1959 | Knox | |
| 3,067,819 | A | | 12/1962 | Gore | |
| 3,104,703 | A | | 9/1963 | Rike et al. | |
| 3,111,991 | A | | 11/1963 | O'Neal | |
| 3,167,122 | A | | 1/1965 | Lang | |
| 3,175,618 | A | | 3/1965 | Lang et al. | |
| 3,179,168 | A | | 4/1965 | Vincent | |
| 3,188,816 | A | * | 6/1965 | Koch | 405/225 |
| 3,191,677 | A | | 6/1965 | Kinley | |
| 3,191,680 | A | | 6/1965 | Vincent | |
| 3,203,451 | A | | 8/1965 | Vincent | |
| 3,203,483 | A | | 8/1965 | Vincent | |
| 3,209,546 | A | * | 10/1965 | Lawton | 405/238 |
| 3,245,471 | A | | 4/1966 | Howard | |
| 3,270,817 | A | | 9/1966 | Papaila | |
| 3,297,092 | A | | 1/1967 | Jennings | |
| 3,326,293 | A | | 6/1967 | Skipper | |
| 3,353,599 | A | | 11/1967 | Swift | |
| 3,354,955 | A | | 11/1967 | Berry | |
| 3,358,760 | A | | 12/1967 | Blagg | |
| 3,358,769 | A | | 12/1967 | Berry | |
| 3,364,993 | A | | 1/1968 | Skipper | |
| 3,412,565 | A | | 11/1968 | Lindsey et al. | |
| 3,419,080 | A | | 12/1968 | Lebourg | |
| 3,424,244 | A | | 1/1969 | Kinley | |
| 3,477,506 | A | | 11/1969 | Malone | |
| 3,489,220 | A | | 1/1970 | Kinley | |
| 3,498,376 | A | | 3/1970 | Sizer et al. | |
| 3,568,773 | A | | 3/1971 | Chancellor | |
| 3,669,190 | A | | 6/1972 | Sizer et al. | 166/315 |
| 3,687,196 | A | | 8/1972 | Mullins | 166/217 |
| 3,691,624 | A | | 9/1972 | Kinley | 29/523 |
| 3,693,717 | A | | 9/1972 | Wuenschel | 166/285 |
| 3,711,123 | A | | 1/1973 | Arnold | |
| 3,712,376 | A | | 1/1973 | Owen et al. | 166/277 |
| 3,746,068 | A | | 7/1973 | Deckert et al. | |
| 3,746,091 | A | | 7/1973 | Owen et al. | 166/207 |
| 3,746,092 | A | | 7/1973 | Land | 166/207 |
| 3,764,168 | A | | 10/1973 | Kisling, III et al. | |
| 3,776,307 | A | | 12/1973 | Young | 166/125 |
| 3,779,025 | A | * | 12/1973 | Godley et al. | 405/249 |
| 3,780,562 | A | | 12/1973 | Kinley | |
| 3,785,193 | A | | 1/1974 | Kinley et al. | 72/393 |
| 3,797,259 | A | | 3/1974 | Kammerer, Jr. | |
| 3,812,912 | A | | 5/1974 | Wuenschel | 166/207 |
| 3,818,734 | A | | 6/1974 | Bateman | |
| 3,887,006 | A | | 6/1975 | Pitts | |
| 3,915,478 | A | | 10/1975 | Al et al. | |
| 3,935,910 | A | | 2/1976 | Gaudy et al. | |
| 3,945,444 | A | | 3/1976 | Knudson | 175/92 |
| 3,948,321 | A | | 4/1976 | Owen et al. | 166/277 |
| 3,977,473 | A | | 8/1976 | Page, Jr. | 166/315 |
| 3,997,193 | A | | 12/1976 | Tsuda et al. | |
| 4,026,583 | A | | 5/1977 | Gottlieb | |
| 4,069,573 | A | | 1/1978 | Rogers, Jr. et al. | 29/421 R |
| 4,076,287 | A | | 2/1978 | Bill et al. | |
| 4,096,913 | A | | 6/1978 | Kenneday et al. | |
| 4,098,334 | A | | 7/1978 | Crowe | |
| 4,190,108 | A | | 2/1980 | Webber | |
| 4,205,422 | A | | 6/1980 | Hardwick | |
| 4,253,687 | A | | 3/1981 | Maples | |
| RE30,802 | E | | 11/1981 | Rogers, Jr. | 29/421 R |
| 4,304,428 | A | | 12/1981 | Grigorian et al. | |
| 4,359,889 | A | | 11/1982 | Kelly | |
| 4,363,358 | A | | 12/1982 | Ellis | 166/212 |
| 4,366,971 | A | | 1/1983 | Lula | |
| 4,368,571 | A | | 1/1983 | Cooper, Jr. | 29/421 R |
| 4,379,471 | A | | 4/1983 | Kuenzel | |
| 4,391,325 | A | | 7/1983 | Baker et al. | 166/208 |
| 4,393,931 | A | | 7/1983 | Muse et al. | |
| 4,407,681 | A | | 10/1983 | Ina et al. | |
| 4,411,435 | A | | 10/1983 | McStravick | |
| 4,413,395 | A | | 11/1983 | Garnier | |
| 4,413,682 | A | * | 11/1983 | Callihan et al. | 166/217 X |
| 4,420,866 | A | | 12/1983 | Mueller | |
| 4,421,169 | A | | 12/1983 | Dearth et al. | 166/285 |
| 4,423,889 | A | | 1/1984 | Weise | |
| 4,423,986 | A | | 1/1984 | Skogberg | |
| 4,429,741 | A | | 2/1984 | Hyland | |
| 4,440,233 | A | | 4/1984 | Baugh et al. | 166/382 |
| 4,462,471 | A | | 7/1984 | Hipp | |
| 4,483,399 | A | | 11/1984 | Colgate | 166/308 |
| 4,485,847 | A | | 12/1984 | Wentzell | 138/89 |
| 4,501,327 | A | | 2/1985 | Retz | 166/285 |
| 4,505,017 | A | | 3/1985 | Schukei | 29/157.3 R |
| 4,508,129 | A | | 4/1985 | Brown | |
| 4,511,289 | A | | 4/1985 | Herron | |
| 4,519,456 | A | | 5/1985 | Cochran | |
| 4,526,232 | A | | 7/1985 | Hughson et al. | |
| 4,553,776 | A | | 11/1985 | Dodd | 285/212 |
| 4,573,248 | A | | 3/1986 | Hackett | |
| 4,576,386 | A | | 3/1986 | Benson et al. | |
| 4,590,995 | A | | 5/1986 | Evans | |
| 4,592,577 | A | | 6/1986 | Ayres et al. | |
| 4,605,063 | A | | 8/1986 | Ross | |
| 4,611,662 | A | | 9/1986 | Harrington | |
| 4,629,218 | A | | 12/1986 | Dubois | |
| 4,632,944 | A | | 12/1986 | Thompson | |
| 4,634,317 | A | | 1/1987 | Skogberg et al. | |
| 4,635,333 | A | | 1/1987 | Finch | |
| 4,637,436 | A | | 1/1987 | Stewart, Jr. et al. | |
| 4,646,787 | A | | 3/1987 | Rush et al. | |
| 4,651,836 | A | | 3/1987 | Richards | |
| 4,660,863 | A | | 4/1987 | Bailey et al. | |
| 4,662,446 | A | | 5/1987 | Brisco et al. | 166/278 |
| 4,669,541 | A | | 6/1987 | Bissonnette | |
| 4,682,797 | A | | 7/1987 | Hildner | |
| 4,685,191 | A | | 8/1987 | Mueller et al. | |
| 4,685,834 | A | * | 8/1987 | Jordan | 405/237 |
| 4,711,474 | A | | 12/1987 | Patrick | |
| 4,730,851 | A | | 3/1988 | Watts | |
| 4,735,444 | A | | 4/1988 | Skipper | |
| 4,739,916 | A | | 4/1988 | Ayres et al. | |
| 4,776,394 | A | | 10/1988 | Lynde et al. | |
| 4,793,382 | A | | 12/1988 | Szalvay | |
| 4,796,668 | A | | 1/1989 | Depret | |
| 4,817,710 | A | | 4/1989 | Edwards et al. | |
| 4,817,716 | A | | 4/1989 | Taylor et al. | 166/277 |
| 4,827,594 | A | | 5/1989 | Cartry et al. | |
| 4,830,109 | A | | 5/1989 | Wedel | 166/277 |
| 4,865,127 | A | | 9/1989 | Koster | 166/277 |
| 4,893,658 | A | | 1/1990 | Kimura et al. | |
| 4,907,828 | A | | 3/1990 | Change | |
| 4,913,758 | A | | 4/1990 | Koster | 156/191 |
| 4,915,426 | A | | 4/1990 | Skipper | |
| 4,934,312 | A | | 6/1990 | Koster et al. | |
| 4,941,512 | A | | 7/1990 | McParland | |
| 4,941,532 | A | | 7/1990 | Hurt et al. | |
| 4,958,691 | A | | 9/1990 | Hipp | |
| 4,968,184 | A | | 11/1990 | Reid | |
| 4,971,152 | A | | 11/1990 | Koster et al. | |

4,976,322 A 12/1990 Abdrakhmanov et al. .... 175/57
4,981,250 A 1/1991 Persson
5,014,779 A 5/1991 Meling et al. ..... 166/55.7
5,031,699 A 7/1991 Artynov et al.
5,040,283 A 8/1991 Pelgrom ..... 29/447
5,052,483 A 10/1991 Hudson
5,059,043 A 10/1991 Kuhne
5,079,837 A 1/1992 Vanselow
5,083,608 A 1/1992 Abdrakhmanov et al. .... 166/55
5,093,015 A 3/1992 Oldiges
5,107,221 A 4/1992 N'Guyen et al.
5,119,661 A 6/1992 Abdrakhmanov et al.
5,156,043 A 10/1992 Ose
5,156,223 A 10/1992 Hipp
5,174,376 A 12/1992 Singeetham ..... 166/208
5,197,553 A 3/1993 Leturno ..... 175/57
5,209,600 A 5/1993 Koster
5,226,492 A 7/1993 Solaeche P. et al. ..... 166/196
5,286,393 A 2/1994 Oldiges et al.
5,314,209 A 5/1994 Kuhne
5,318,122 A 6/1994 Murray et al.
5,318,131 A 6/1994 Baker ..... 166/382
5,325,923 A 7/1994 Surjaatmadja et al. ..... 166/308
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,339,894 A 8/1994 Stotler
5,346,007 A 9/1994 Dillon et al.
5,348,087 A 9/1994 Williamson, Jr.
5,348,093 A 9/1994 Wood et al.
5,348,095 A 9/1994 Worrall et al. ..... 166/380
5,348,668 A 9/1994 Oldiges et al.
5,351,752 A 10/1994 Wood et al.
5,360,292 A * 11/1994 Allen et al. ..... 405/249
5,361,843 A 11/1994 Shy et al.
5,366,010 A 11/1994 Zwart ..... 166/120
5,366,012 A 11/1994 Lohbeck ..... 166/277
5,368,075 A 11/1994 Bäro et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al. ..... 166/297
5,396,957 A 3/1995 Surjaatmadja et al.
5,405,171 A 4/1995 Allen et al.
5,425,559 A 6/1995 Nobileau
5,426,130 A 6/1995 Thurber et al.
5,435,395 A 7/1995 Connell
5,439,320 A 8/1995 Abrams ..... 405/154
5,454,419 A 10/1995 Vloedman
5,467,822 A 11/1995 Zwart ..... 166/179
5,472,055 A 12/1995 Simson et al.
5,474,334 A 12/1995 Eppink
5,494,106 A 2/1996 Gueguen et al. ..... 166/277
5,507,343 A 4/1996 Carlton et al. ..... 166/277
5,511,620 A 4/1996 Baugh et al.
5,535,824 A 7/1996 Hudson ..... 166/207
5,536,422 A 7/1996 Oldiges et al.
5,576,485 A 11/1996 Serata
5,606,792 A 3/1997 Schafer ..... 29/727
5,611,399 A 3/1997 Richard et al.
5,613,557 A 3/1997 Blount et al. ..... 166/277
5,617,918 A 4/1997 Cooksey et al. ..... 166/115
5,642,560 A 7/1997 Tabuchi et al.
5,642,781 A 7/1997 Richard
5,664,327 A 9/1997 Swars
5,667,011 A 9/1997 Gill et al. ..... 166/295
5,667,252 A 9/1997 Schafer et al. ..... 285/15
5,685,369 A 11/1997 Ellis et al. ..... 166/195
5,695,008 A 12/1997 Bertet et al. ..... 166/187
5,695,009 A 12/1997 Hipp
5,718,288 A 2/1998 Bertet et al. ..... 166/287
5,785,120 A 7/1998 Smalley et al. ..... 166/55
5,787,933 A 8/1998 Russ et al.
5,791,419 A 8/1998 Valisalo ..... 175/53
5,794,702 A 8/1998 Nobileau ..... 166/380
5,797,454 A 8/1998 Hipp
5,829,520 A 11/1998 Johnson ..... 166/250.01
5,829,524 A 11/1998 Flanders et al. ..... 166/277
5,833,001 A 11/1998 Song et al.
5,849,188 A 12/1998 Voll et al.
5,857,524 A 1/1999 Harris
5,875,851 A 3/1999 Vick, Jr. et al. ..... 166/386
5,885,941 A 3/1999 Sateva et al.
5,901,789 A 5/1999 Donnelly et al. ..... 166/381
5,918,677 A 7/1999 Head
5,924,745 A 7/1999 Campbell ..... 285/90
5,931,511 A 8/1999 DeLange et al.
5,944,100 A 8/1999 Hipp
5,944,107 A 8/1999 Ohmer ..... 166/313
5,951,207 A * 9/1999 Chen ..... 405/249 X
5,957,195 A 9/1999 Bailey et al. ..... 166/55
5,979,560 A 11/1999 Nobileau ..... 166/381
5,984,369 A 11/1999 Crook et al.
5,984,568 A 11/1999 Lohbeck ..... 403/375
6,012,522 A 1/2000 Donnelly et al. ..... 166/276
6,012,523 A 1/2000 Campbell et al. ..... 166/277
6,012,874 A * 1/2000 Gronock et al. ..... 405/249 X
6,017,168 A 1/2000 Fraser et al.
6,021,850 A 2/2000 Wood et al. ..... 166/380
6,029,748 A 2/2000 Forsyth et al. ..... 166/380
6,035,954 A 3/2000 Hipp
6,044,906 A 4/2000 Saltel ..... 166/187
6,047,505 A * 4/2000 Willow ..... 405/253 X
6,047,774 A 4/2000 Allen
6,050,341 A 4/2000 Metcalf ..... 166/383
6,050,346 A 4/2000 Hipp
6,056,059 A 5/2000 Ohmer ..... 166/313
6,062,324 A 5/2000 Hipp
6,065,500 A 5/2000 Metcalfe ..... 138/118
6,070,671 A 6/2000 Cumming et al. ..... 166/381
6,074,133 A * 6/2000 Kelsey ..... 405/244
6,078,031 A 6/2000 Bliault et al. ..... 219/607
6,079,495 A 6/2000 Ohmer ..... 166/313
6,085,838 A * 7/2000 Vercaemer et al. ..... 166/277
6,089,320 A 7/2000 LaGrange ..... 166/313
6,098,717 A 8/2000 Bailey et al. ..... 166/382
6,102,119 A * 8/2000 Raines ..... 166/207 X
6,109,355 A 8/2000 Reid
6,112,818 A 9/2000 Campbell ..... 166/384
6,135,208 A * 10/2000 Gano et al. ..... 166/313
6,142,230 A 11/2000 Smalley et al.
6,182,775 B1 2/2001 Hipp
6,196,336 B1 3/2001 Fincher et al.
6,226,855 B1 5/2001 Maine
6,250,385 B1 * 6/2001 Mantaron ..... 166/207
6,263,968 B1 7/2001 Freeman et al.
6,263,972 B1 7/2001 Richard et al.
6,283,211 B1 9/2001 Vloedman
6,315,043 B1 11/2001 Farrant et al.
6,328,113 B1 12/2001 Cook
6,354,373 B1 3/2002 Vercaemer et al.
6,419,033 B1 7/2002 Hahn et al.
6,446,724 B2 9/2002 Baugh et al.
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,470,966 B2 * 10/2002 Cook et al. ..... 166/207

| | | | | |
|---|---|---|---|---|
| 6,497,289 | B1 | * 12/2002 | Cook et al. | 166/380 |
| 2001/0002626 | A1 | * 6/2001 | Frank et al. | 175/57 |
| 2001/0020532 | A1 | 9/2001 | Baugh et al. | |
| 2001/0047866 | A1 | * 12/2001 | Cook et al. | 166/277 |
| 2002/0011339 | A1 | 1/2002 | Murray | |
| 2002/0014339 | A1 | 2/2002 | Ross | |
| 2002/0062956 | A1 | 5/2002 | Murray et al. | |
| 2002/0066578 | A1 | 6/2002 | Broome | |
| 2002/0070023 | A1 | 6/2002 | Turner et al. | |
| 2002/0070031 | A1 | 6/2002 | Voll et al. | |
| 2002/0079101 | A1 | 6/2002 | Baugh et al. | |
| 2002/0092654 | A1 | 7/2002 | Coronado et al. | |
| 2002/0139540 | A1 | 10/2002 | Lauritzen | |
| 2002/0144822 | A1 | 10/2002 | Hackworth et al. | |
| 2002/0148612 | A1 | 10/2002 | Cook et al. | |

FOREIGN PATENT DOCUMENTS

| | | | | |
|---|---|---|---|---|
| EP | 0823534 | | 2/1998 | E21B/7/06 |
| EP | 881354 | * | 12/1998 | |
| EP | 0881354 | | 12/1998 | E21B/43/10 |
| EP | 0881359 | | 12/1998 | E21D/9/08 |
| EP | 0899420 | | 3/1999 | E21B/43/10 |
| EP | 0937861 | | 8/1999 | E21B/43/10 |
| EP | 0952305 | | 10/1999 | E21B/43/10 |
| EP | 0952306 | | 10/1999 | E21B/43/10 |
| FR | 2717855 | | 9/1995 | E21B/17/00 |
| FR | 2741907 | | 6/1997 | E21B/7/20 |
| FR | 2771133 | A | 5/1999 | |
| FR | 2780751 | | 1/2000 | E21B/33/127 |
| GB | 557823 | | 12/1943 | |
| GB | 961750 | | 6/1964 | |
| GB | 1062610 | | 3/1967 | |
| GB | 1111536 | | 5/1968 | |
| GB | 1448304 | | 9/1976 | |
| GB | 1563740 | | 3/1980 | |
| GB | 2058877 | | 4/1981 | |
| GB | 2115860 | A | 9/1983 | |
| GB | 2216926 | A | 10/1989 | |
| GB | 2243191 | A | 10/1991 | |
| GB | 2256910 | | 12/1992 | F16L/9/18 |
| GB | 2305682 | A | 4/1997 | |
| GB | 2322655 | | 9/1998 | E21B/23/04 |
| GB | 2326896 | | 1/1999 | E21B/17/00 |
| GB | 2329916 | | 4/1999 | E21B/17/00 |
| GB | 2329918 | | 4/1999 | E21B/29/00 |
| GB | 2336383 | | 10/1999 | E21B/43/08 |
| GB | 2355738 | A | 4/2000 | |
| GB | 2343691 | A | 5/2000 | |
| GB | 2344606 | A | 6/2000 | |
| GB | 2368865 | A | 7/2000 | |
| GB | 2346165 | A | 8/2000 | |
| GB | 2346632 | A | 8/2000 | |
| GB | 2347445 | A | 9/2000 | |
| GB | 2347446 | A | 9/2000 | |
| GB | 2347950 | A | 9/2000 | |
| GB | 2348223 | A | 9/2000 | |
| GB | 3247952 | A | 9/2000 | |
| GB | 2348657 | A | 10/2000 | |
| GB | 2357099 | A | 12/2000 | |
| GB | 2350137 | B | 8/2001 | |
| GB | 2359837 | B | 4/2002 | |
| GB | 2367842 | A | 10/2002 | |
| JP | 208458 | | 10/1985 | C22C/38/52 |
| JP | 01075715 | * | 3/1989 | 405/232 |
| JP | 6475715 | | 3/1989 | |
| JP | 102875 | | 4/1995 | E21D/5/10 |
| JP | 94068 | | 4/2000 | |
| JP | 107870 | | 4/2000 | |
| JP | 162192 | | 6/2000 | |
| NL | 9001081 | | 12/1991 | E21B/33/12 |
| RO | 113267 | | 5/1998 | E21B/10/32 |
| RU | 2016345 | | 7/1994 | F16L/58/00 |
| RU | 2039214 | | 7/1995 | E21B/43/00 |
| RU | 2056201 | | 3/1996 | B21D/39/10 |
| RU | 2064357 | | 7/1996 | B21D/39/10 |
| RU | 2068940 | | 11/1996 | E21B/29/10 |
| RU | 2068943 | | 11/1996 | E21B/33/13 |
| RU | 2079633 | | 5/1997 | E21B/7/06 |
| RU | 2083798 | | 7/1997 | E21B/33/12 |
| RU | 2091655 | | 9/1997 | F16L/9/02 |
| RU | 2095179 | | 11/1997 | B21D/39/04 |
| RU | 2105128 | | 2/1998 | E21B/29/00 |
| RU | 2108445 | | 4/1998 | E21B/33/13 |
| RU | 2144128 | | 1/2000 | E21B/29/10 |
| SU | 350833 | | 9/1972 | C21C/5/52 |
| SU | 607950 | | 5/1978 | E21B/29/00 |
| SU | 612004 | | 5/1978 | E21B/29/00 |
| SU | 620582 | | 7/1978 | E21B/29/00 |
| SU | 641070 | | 1/1979 | |
| SU | 832049 | | 5/1981 | |
| SU | 853089 | | 8/1981 | |
| SU | 874952 | | 10/1981 | E21B/17/28 |
| SU | 894169 | | 1/1982 | E21B/7/28 |
| SU | 899850 | | 1/1982 | |
| SU | 907220 | | 2/1982 | E21B/33/12 |
| SU | 909114 | | 2/1982 | |
| SU | 953172 | | 8/1982 | E21B/7/20 |
| SU | 959878 | | 9/1982 | B21D/41/02 |
| SU | 976019 | | 11/1982 | E21B/29/10 |
| SU | 976020 | | 11/1982 | E21B/29/10 |
| SU | 989038 | | 1/1983 | E21B/29/10 |
| SU | 1002514 | | 3/1983 | E21B/29/10 |
| SU | 1041671 | | 9/1983 | E21B/29/10 |
| SU | 1051222 | | 10/1983 | E21B/29/10 |
| SU | 1086118 | | 4/1984 | E21B/29/00 |
| SU | 1158400 | | 5/1985 | B60M/3/00 |
| SU | 1212575 | | 2/1986 | E21B/7/28 |
| SU | 1250637 | | 8/1986 | E21B/7/20 |
| SU | 1411434 | | 7/1988 | E21B/29/10 |
| SU | 1430498 | | 10/1988 | E21B/29/10 |
| SU | 1432190 | | 10/1988 | E21B/29/10 |
| SU | 1601330 | | 10/1990 | E21B/29/10 |
| SU | 1627663 | | 2/1991 | E21B/29/10 |
| SU | 1659621 | A1 | 6/1991 | |
| SU | 1663179 | | 7/1991 | E21B/29/10 |
| SU | 1663180 | | 7/1991 | E21B/29/10 |
| SU | 1677225 | | 9/1991 | E21B/7/28 |
| SU | 1677248 | | 9/1991 | E21B/29/10 |
| SU | 1686123 | | 10/1991 | E21B/29/10 |
| SU | 1686124 | | 10/1991 | E21B/29/10 |
| SU | 1686125 | | 10/1991 | E21B/29/10 |
| SU | 1698413 | | 12/1991 | E21B/7/28 |
| SU | 1710694 | | 2/1992 | E21B/29/10 |
| SU | 1730429 | | 4/1992 | E21B/33/13 |
| SU | 1745873 | | 7/1992 | E21B/29/10 |
| SU | 1747673 | | 7/1992 | E21B/29/10 |
| SU | 1749267 | | 7/1992 | C21D/9/08 |
| SU | 1786241 | | 1/1993 | E21B/33/10 |
| SU | 1804543 | | 3/1993 | E21B/29/10 |
| SU | 1810482 | | 4/1993 | E21B/29/10 |
| SU | 1818459 | | 5/1993 | E21B/29/10 |
| SU | 1295799 | | 2/1995 | E21B/29/10 |
| WO | 8100132 | | 1/1981 | E21B/43/10 |
| WO | 9005598 | | 3/1990 | B21C/3/08 |
| WO | 9201859 | | 2/1992 | E21D/20/00 |
| WO | 9208875 | | 5/1992 | |
| WO | WO-9325799 | * | 12/1993 | |
| WO | 9325799 | | 12/1993 | E21B/43/10 |
| WO | 9325800 | | 12/1993 | E21B/43/10 |
| WO | 9421887 | | 9/1994 | E21B/33/14 |
| WO | 9425655 | | 11/1994 | D04C/1/06 |
| WO | 9503476 | | 2/1995 | E21B/43/10 |

| | | | | |
|---|---|---|---|---|
| WO | 9601937 | | 1/1996 | ..... E21B/33/127 |
| WO | 9621083 | | 7/1996 | ..... E21B/43/10 |
| WO | 9626350 | | 8/1996 | ..... E21B/43/11 |
| WO | 9637681 | | 11/1996 | ..... E21B/17/08 |
| WO | 9706346 | | 2/1997 | ..... E21B/43/10 |
| WO | 9711306 | | 3/1997 | ..... F16L/55/165 |
| WO | 9717524 | | 5/1997 | ..... E21B/43/08 |
| WO | 9717526 | | 5/1997 | ..... E21B/43/10 |
| WO | 9717527 | | 5/1997 | ..... E21B/43/10 |
| WO | 9720130 | | 6/1997 | ..... E21B/43/10 |
| WO | 9721901 | | 6/1997 | ..... E21B/17/08 |
| WO | 9800626 | * | 1/1998 | |
| WO | 9807957 | | 2/1998 | ..... E21B/43/10 |
| WO | 9809053 | | 3/1998 | ..... E21B/33/14 |
| WO | 9822690 | | 5/1998 | ..... E21B/17/08 |
| WO | 9826152 | | 6/1998 | ..... E21B/17/08 |
| WO | 9842947 | | 10/1998 | ..... E21B/17/08 |
| WO | 9849423 | | 11/1998 | ..... E21B/43/10 |
| WO | 9902818 | | 1/1999 | ..... E21B/43/10 |
| WO | 9904135 | | 1/1999 | ..... E21B/23/00 |
| WO | 9906670 | | 2/1999 | |
| WO | 9908827 | | 2/1999 | ..... B23K/13/02 |
| WO | 99038828 | | 2/1999 | ..... B23K/20/02 |
| WO | 9918328 | | 4/1999 | ..... E21B/23/01 |
| WO | 9923354 | | 5/1999 | ..... E21B/43/10 |
| WO | 9925524 | | 5/1999 | ..... B26F/1/00 |
| WO | 9925951 | | 5/1999 | ..... E21B/43/10 |
| WO | 9935368 | | 7/1999 | ..... E21B/43/10 |
| WO | 9943923 | | 9/1999 | ..... E21B/33/13 |
| WO | 0001926 | | 1/2000 | ..... E21B/43/26 |
| WO | 0004271 | | 1/2000 | ..... E21B/17/07 |
| WO | 0008301 | | 2/2000 | ..... E21B/43/08 |
| WO | 0026500 | | 5/2000 | |
| WO | 0026501 | | 5/2000 | |
| WO | 0026502 | | 5/2000 | |
| WO | 0031375 | | 6/2000 | |
| WO | 0037767 | | 6/2000 | |
| WO | 0037768 | | 6/2000 | |
| WO | 0037771 | | 6/2000 | |
| WO | 0037772 | | 6/2000 | |
| WO | 0034932 | | 7/2000 | |
| WO | 0046484 | | 8/2000 | |
| WO | 0050727 | | 8/2000 | |
| WO | 0050732 | | 8/2000 | |
| WO | 0050733 | | 8/2000 | |
| WO | 0077431 | A2 | 12/2000 | |
| WO | 02075107 | A1 | 9/2002 | |
| WO | 02081863 | A1 | 10/2002 | |
| WO | 02081864 | A2 | 10/2002 | |

* cited by examiner

SYSTEM AND METHOD FOR DRIVING PIPE

CROSS REFERENCE TO RELATED APPLICATIONS

This application claims the benefit of the filing date of U.S. Provisional Patent Application Serial No. 60/121,907, filed on Feb. 26, 1999, the disclosure of which is incorporated herein by reference.

This application is a continuation-in-part of U.S. patent application Ser. No. 09/454,139, filed on Dec. 3, 1999, which claimed benefit of the filing date of U.S. provisional patent application serial No. 60/111,293, filed on Dec. 7, 1998.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming wellbores.

SUMMARY OF THE INVENTION

According to one aspect of the present invention, a method of driving a pipe into a subterranean formation is provided that includes driving a hole into the subterranean formation using an expansion cone.

According to another aspect of the present invention, a method of forming a casing in a wellbore is provided that includes driving a hole into the bottom of the wellbore using an expansion cone and radially expanding the casing using the expansion cone.

According to another aspect of the present invention, a method of forming a support structure in a shaft is provided that includes driving a hole into the bottom of the shaft using an expansion cone and radially expanding the support structure using the expansion cone.

According to another aspect of the present invention, a wellbore casing is provided that includes an expanded tubular member positioned in intimate contact with the walls of a wellbore. The expanded tubular member is positioned by the process of: driving a hole into the bottom of the wellbore using an expansion cone and radially expanding the tubular member using the expansion cone.

According to another aspect of the present invention, a support structure is provided that includes an expanded tubular member positioned in intimate contact with the walls of a shaft. The expanded tubular member is positioned by the process of: driving a hole into the bottom of the shaft using an expansion cone and radially expanding the tubular member using the expansion cone.

According to another aspect of the present invention, an apparatus for driving an opening into the bottom of a shaft is provided that includes an expansion cone adapted to radially expand a tubular member and a hammer for driving the expansion cone into the bottom of the shaft.

DETAILED DESCRIPTION OF THE ILLUSTRATIVE EMBODIMENTS

An apparatus and method for forming a wellbore casing within a subterranean formation is provided. The apparatus and method permits a wellbore casing to be formed in a subterranean formation by placing a tubular member and a mandrel in a new section of a wellbore, driving the mandrel into the bottom of the wellbore, and radially expanding the tubular member into contact with the wellbore. The method and apparatus have general application to the creation and/or repair of wellbore casings, pipelines, and structural supports.

Referring to FIGS. 1–6, an embodiment of an apparatus and method for forming a wellbore casing will now be described. The apparatus and method may be used to form or repair a wellbore casing, pipeline, or structural support member.

Figure 1:
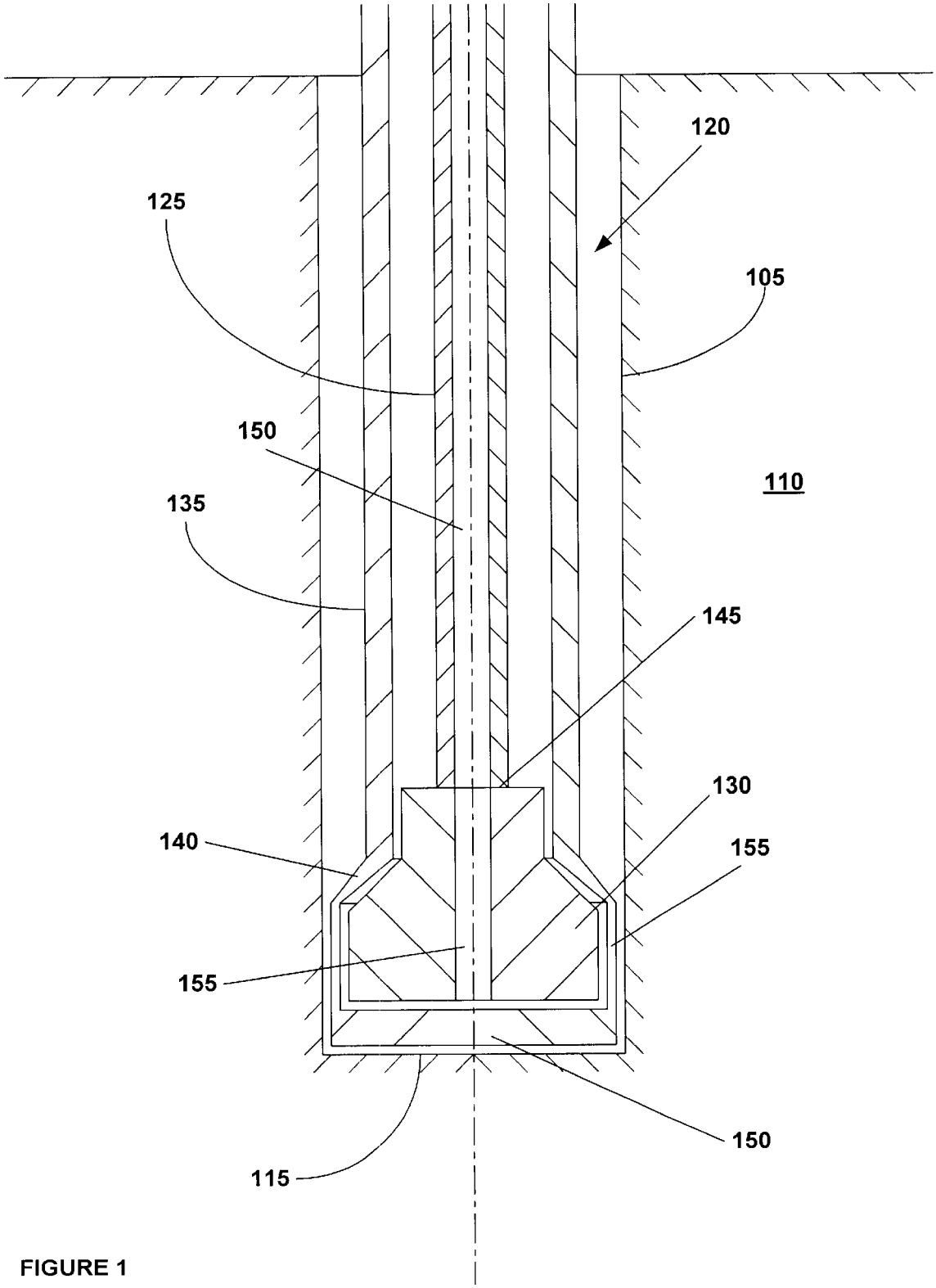
FIG. 1 is a cross-sectional view illustrating an embodiment of an apparatus for forming a wellbore casing positioned within a well borehole.

As illustrated in FIG. 1, a wellbore 105 is formed in a subterranean formation 110 in a conventional manner. An apparatus 120 for forming a wellbore casing is then positioned within the wellbore 105. In a preferred embodiment, the apparatus 120 is positioned on the bottom 115 of the wellbore 105. In a preferred embodiment, the apparatus 120 is used to form a wellbore casing within the wellbore 105. In several alternative embodiments, the apparatus 120 is used to form or repair a wellbore casing, a pipeline, or a structural support.

In a preferred embodiment, the apparatus 120 includes a support member 125, an expansion cone 130, an expandable tubular member 135, and an expansion cone launcher 140.

The support member 125 is preferably removably coupled to the expansion cone 130. The support member 125 is further preferably adapted to be supported and positioned using conventional equipment. The support member 125 preferably further includes a releasable coupling 145 for releasably engaging the expansion cone 130. The support member 125 further preferably includes a fluid passage 150 for conveying fluidic materials.

The expansion cone 130 is preferably releasably coupled to the support member 125. The expansion cone 130 is further preferably movably coupled to the expansion cone launcher 140. The expansion cone 130 further preferably includes a fluid passage 155 for conveying fluidic materials.

In a preferred embodiment, the expansion cone 130 is further provided substantially as described in one or more of the following: (1) U.S. patent application Ser. No. 09/440,338, filed on Nov. 15, 1999, which claimed the benefit of the filing date of U.S. Provisional Patent Application Serial No. 60/108,558, filed on Nov. 16, 1998, (2) U.S. patent application Ser. No. 09/454,139, filed on Dec. 3, 1999, which claimed the benefit of the filing date of U.S. Provisional Patent Application Serial No. 60/111,293, filed on Dec. 7, 1998, (3) U.S. patent application Ser. No. 09/502,350, filed on Feb. 10, 2000, which claimed the benefit of the filing date of U.S. Provisional Patent Application Serial No. 60/119,611, filed on Feb. 11, 1999, (4) U.S. patent application Ser. No. 09/510,913, filed on Feb. 23, 2000, which claimed the benefit of the filing date of U.S. Provisional Patent Application Serial No. 60/121,702, filed on Feb. 25, 1999, (4) U.S. patent application Ser. No. 09/512,895, filed on Feb. 24, 2000, which claimed the benefit of the filing date of U.S. Provisional Patent Application Serial No. 60/121,841, filed on Feb. 26, 1999, (5) U.S. Provisional Patent Application Serial No. 60/124,042, filed on Mar. 11, 1999, (6) U.S. Provisional Patent Application Serial No. 60/131,106, filed on Apr. 26, 1999, (7) U.S. Provisional Patent Application Serial No. 60/137,998, filed on Jun. 7, 1999, (8) U.S. Provisional Patent Application Serial No. 60/143,039, filed on Jul. 9, 1999, (9) U.S. Provisional Patent Application Serial No. 60/146,203, filed on Jul. 29, 1999, (10) U.S. Provisional Patent Application Serial No. 60/154,047, filed on Sep. 16, 1999, (11) U.S. Provisional Patent Application Serial No. 60/159,082, filed on Oct. 12, 1999, (12) U.S. Provisional Patent Application Serial No. 60/159,039, filed on Oct. 12, 1999, (13) U.S. Provisional Patent Application Serial No. 60/159,033, filed on Oct. 12, 1999, (14) U.S. Provisional Patent Application Serial No. 60/162,671, filed on Nov. 01, 1999, and (15) U.S. Provisional Patent Application Serial No. 60/165,228, filed on Nov. 12, 1999, the disclosures of which are incorporated herein by reference.

In a preferred embodiment, the expandable tubular member 135 is further provided substantially as disclosed in one or more of the following: (1) U.S. patent application Ser. No. 09/440,338, filed on Nov. 15, 1999, which claimed the benefit of the filing date of U.S. Provisional Patent Application Serial No. 60/108,558, filed on Nov. 16, 1998, (2) U.S. Patent Application Serial No. 09/454,139, filed on Dec. 3, 1999, which claimed the benefit of the filing date of U.S. Provisional Patent Application Serial No. 60/111,293, filed on Dec. 7, 1998, (3) U.S. patent application Ser. No. 09/502,350, filed on Feb. 10, 2000, which claimed the benefit of the filing date of U.S. Provisional Patent Application Serial No. 60/119,611, filed on Feb. 11, 1999, (4) U.S. patent application Ser. No. 09/510,913, filed on Feb. 23, 2000, which claimed the benefit of the filing date of U.S. Provisional Patent Application Serial No. 60/121,702, filed on Feb. 25, 1999, (4) U.S. patent application Ser. No. 09/512,895, filed on Feb. 24, 2000, which claimed the benefit of the filing date of U.S. Provisional Patent Application Serial No. 60/121,841, filed on Feb. 26, 1999, (5) U.S. Provisional Patent Application Serial No. 60/124,042, filed on Mar. 11, 1999, (6) U.S. Provisional Patent Application Serial No. 60/131,106, filed on Apr. 26, 1999, (7) U.S. Provisional Patent Application Serial No. 60/137,998, filed on Jun. 7, 1999, (8) U.S. Provisional Patent Application Serial No. 60/143,039, filed on Jul. 9, 1999, (9) U.S. Provisional Patent Application Serial No. 60/146,203, filed on Jul. 29, 1999, (10) U.S. Provisional Patent Application Serial No. 60/154,047, filed on Sep. 16, 1999, (11) U.S. Provisional Patent Application Serial No. 60/159,082, filed on Oct. 12, 1999, (12) U.S. Provisional Patent Application Serial No. 60/159,039, filed on Oct. 12, 1999, (13) U.S. Provisional Patent Application Serial No. 60/159,033, filed on Oct. 12, 1999, (14) U.S. Provisional Patent Application Serial No. 60/162,671, filed on Nov. 01, 1999, and (15) U.S. Provisional Patent Application Serial No. 60/165,228, filed on Nov. 12, 1999, the disclosures of which are incorporated herein by reference.

The expansion cone launcher 140 is preferably coupled to the expandable tubular member 135. The expansion cone launcher 140 is further removably coupled to the expansion cone 130. The expansion cone launcher 140 is further preferably adapted to mate with the expansion cone 130. The expansion cone launcher 140 preferably includes a shoe 150 and a tubular section 155. The expansion cone launcher 140 is preferably adapted to house the expansion cone 130 and facilitate the initiation of the radial expansion of the expandable tubular member 135.

The shoe 150 is coupled to the tubular section 155. The shoe 150 is preferably adapted to mate with a bottom portion of the expansion cone 130. The shoe 150 is preferably fabricated from a material capable of being drilled out using conventional drilling equipment.

In a preferred embodiment, the shoe 150 is further preferably provided as disclosed in one or of the following: (1) U.S. patent application Ser. No. 09/440,338, filed on Nov. 15, 1999, which claimed benefit of the filing date of U.S. Provisional Patent Application Serial No. 60/108,558, filed on Nov. 16, 1998, (2) U.S. patent application Ser. No. 09/454,139, filed on Dec. 3, 1999, which claimed benefit of the filing date of U.S. Provisional Patent Application Serial No. 60/111,293, filed on Dec. 7, 1998, (3) U.S. patent application Ser. No. 09/502,350, filed on Feb. 10, 2000, which claimed the benefit of the filing date of U.S. Provisional Patent Application Serial No. 60/119,611, filed Feb. 11, 1999, (4) U.S. patent application Ser. No. 09/510,913, filed on Feb. 23, 2000, which claimed the benefit of the filing date of U.S. Provisional Patent Application Serial No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Serial No. 60/124,042, filed on Mar. 11, 1999, (7) U.S. Provisional Patent Application Serial No. 60/131,106, filed on Apr. 26, 1999, (8) U.S. Provisional Patent Application Serial No. 60/137,998, filed on Jun. 7, 1999, (9) U.S. Provisional Patent Application Serial No. 60/143,039, filed on Jul. 9, 1999, and (10) U.S. Provisional Patent Application Serial No. 60/146,203, filed on Jul. 29, 1999, the disclosures of which are incorporated by reference.

The tubular section 155 is coupled to the shoe 150 and the lower protion of the expandable tubular member 135. The tubular section 155 is preferably adapted to mate with the expansion cone 130. In a preferred embodiment, the wall thickness of the tubular section 155 is less than the wall thickness of the expandable tubular member 135. In this manner, the initiation of the radial expansion of the expandable tubular member 135 is optimally facilitated.

In a preferred embodiment, the tubular section 155 is provided substantially as described in one or more of the following: (1) U.S. patent application Ser. No. 09/440,338, filed on Nov. 15, 1999, which claimed benefit of the filing date of U.S. Provisional Patent Application Serial No. 60/108,558, filed on Nov. 16, 1998, (2) U.S. patent application Ser. No. 09/454,139, filed on Dec. 3, 1999, which claimed benefit of the filing date of U.S. Provisional Patent Application Serial No. 60/111,293, filed on Dec. 7, 1998, (3) U.S. patent application Ser. No. 09/502,350, filed on Feb. 10, 2000, which claimed the benefit of the filing date of U.S. Provisional Patent Application Serial No. 60/119,611, filed Feb. 11, 1999, (4) U.S. patent application Ser. No. 09/510,913, filed on Feb. 23, 2000, which claimed the benefit of the filing date of U.S. Provisional Patent Application Serial No. 60/121,702, filed on Feb. 25, 1999, (5) U.S. patent application Ser. No. 09/511,941, filed on Feb. 24, 2000, which claimed the benefit of the filing date of U.S. Provisional Patent Application No. 60/121,907, filed Feb. 26, 1999, (6) U.S. Provisional Patent Application Serial No. 60/124,042, filed on Mar. 11, 1999, (7) U.S. Provisional Patent Application Serial No. 60/131,106, filed on Apr. 26, 1999, (8) U.S. Provisional Patent Application Serial No. 60/137,998, filed on Jun. 7, 1999, (9) U.S. Provisional Patent Application Serial No. 60/143,039, filed on Jul. 9, 1999, and (10) U.S. Provisional Patent Application Serial No. 60/146,203, filed on Jul. 29, 1999 the disclosures of which are incorporated by reference.

As illustrated in FIG. 1, the apparatus 120 is preferably initially positioned within the wellbore 105 using the support member 125. In a preferred embodiment, the shoe 150 is positioned onto the bottom 115 of the wellbore 105. In a preferred embodiment, during the initial positioning of the apparatus 120 within the wellbore 105, only the expansion cone launcher 140 contacts the interior surface of the wellbore 105. In this manner, drag and frictional forces are minimized.

Figure 2:
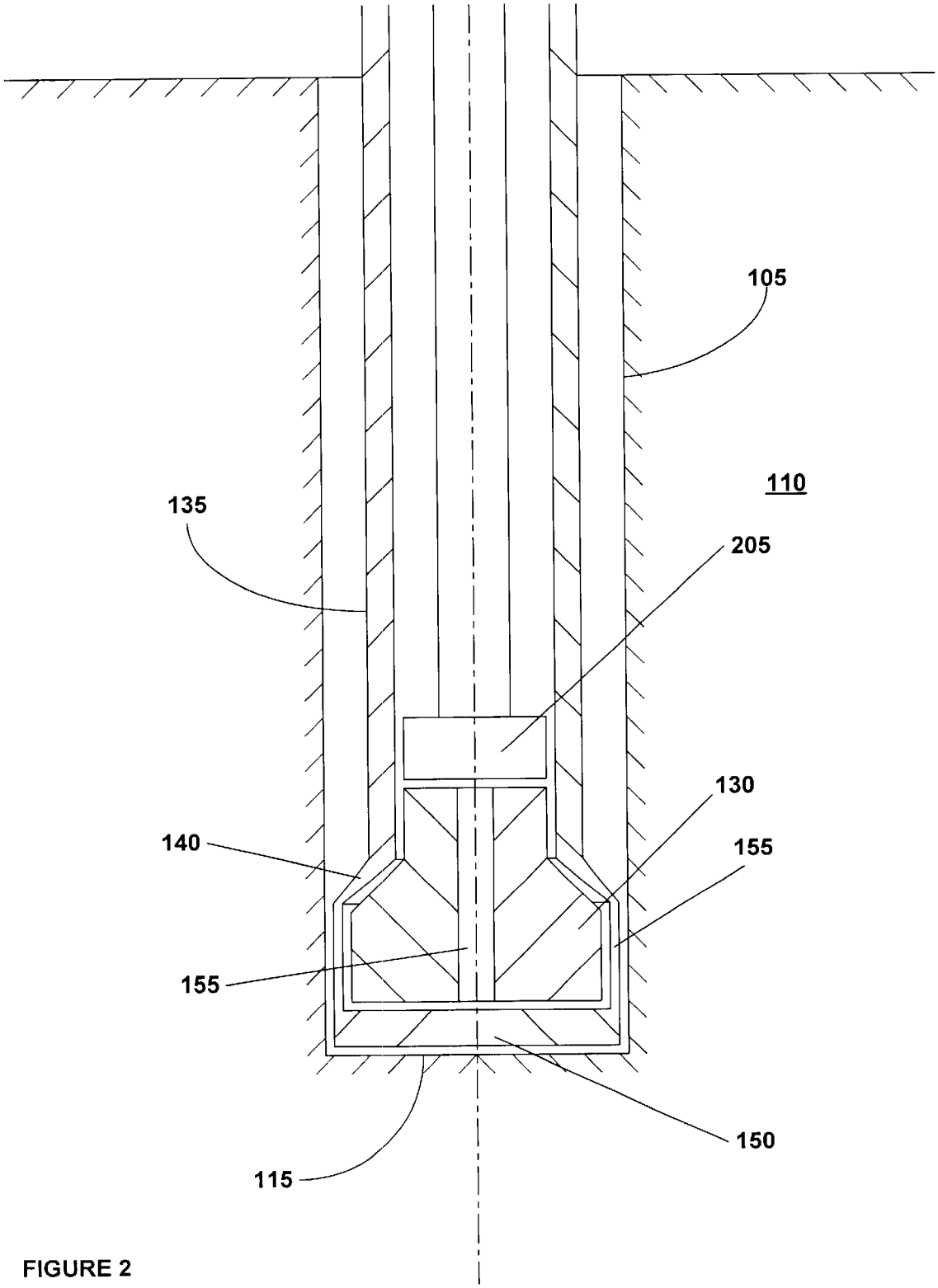
FIG. 2 is a cross-sectional view illustrating the impact driving of the mandrel of the apparatus of FIG. 1.

As illustrated in FIG. 2, in a preferred embodiment, the support member 125 is then decoupled from the expansion cone 130 and removed from the wellbore 105. In a preferred embodiment, a hydraulic hammer 205 is then positioned within the wellbore 105 proximate the expansion cone 130. In a preferred embodiment, the hydraulic hammer 205 is then used to impact and drive the expansion cone 130 into the shoe 150. In a preferred embodiment, in this manner, the shoe 150 is driven deeper within the wellbore 105. In several alternative embodiment, the shoe 155 is driven deeper into the wellbore 105 by driving the top portion of the expandable tubular member 135. In several alternative embodiments, other conventional commercially available impact devices are substituted for the hydraulic hammer 205.

Figure 3:
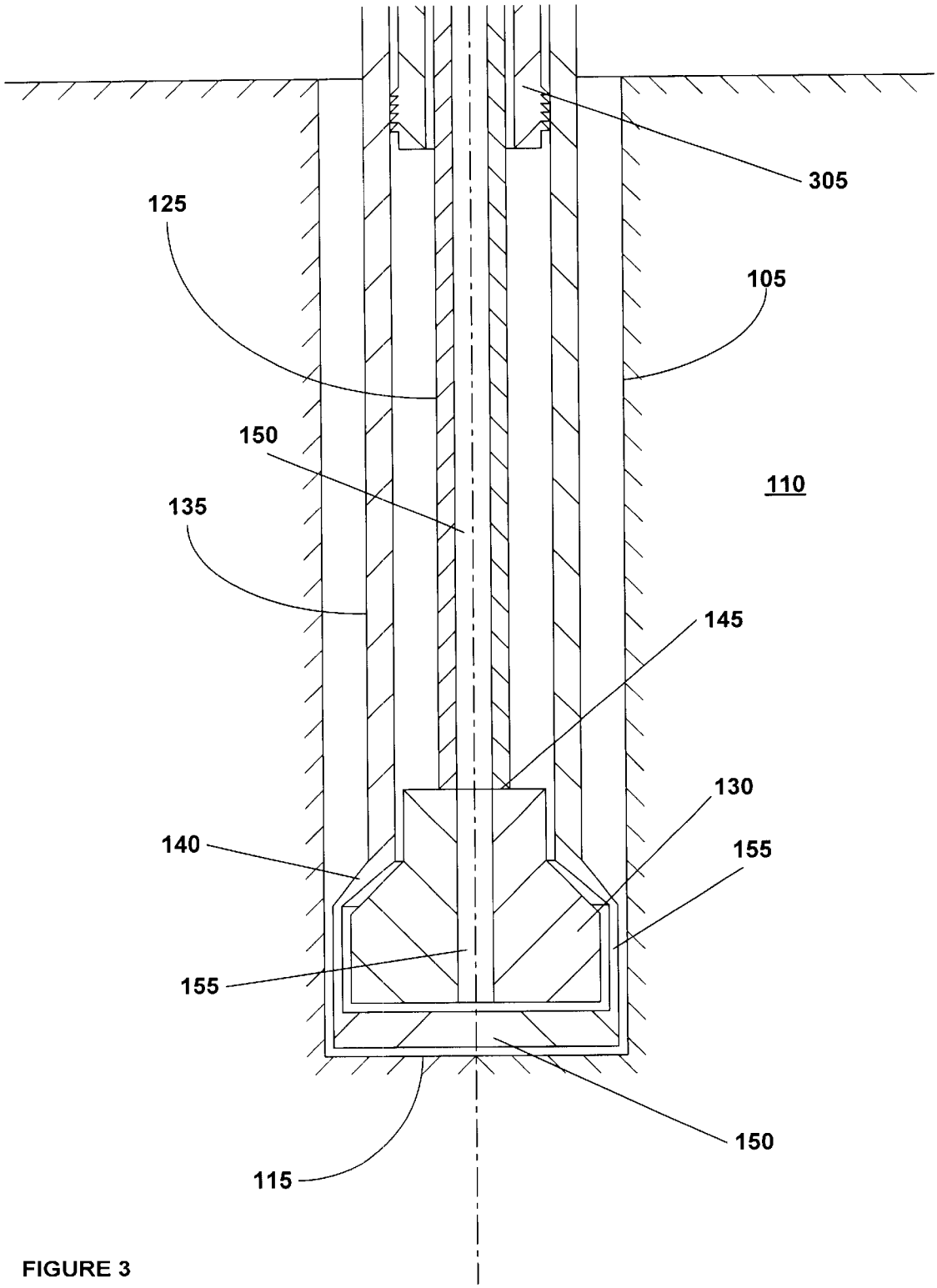
FIG. 3 is a cross-sectional view illustrating the coupling of a tubular member to the mandrel of the apparatus of FIG. 2.

As illustrated in FIG. 3, in a preferred embodiment, the hydraulic hammer 205 is then removed from the wellbore 105. In a preferred embodiment, the support member 125 is then recoupled to the expansion cone 130 and the expandable tubular member 135 is coupled to a restraining device 305. In a preferred embodiment, the restraining device 305 is adapted to prevent the expandable tubular member 135 from moving out of the wellbore 105. In this manner, the expandable tubular member 135 is maintained in a substantially stationary position during the radial expansion of the expandable tubular member 135 using the expansion cone 130. The restraining device 305 may be any number of conventional commercially available restraining devices such as, for example, slips or dogs.

Figure 4:
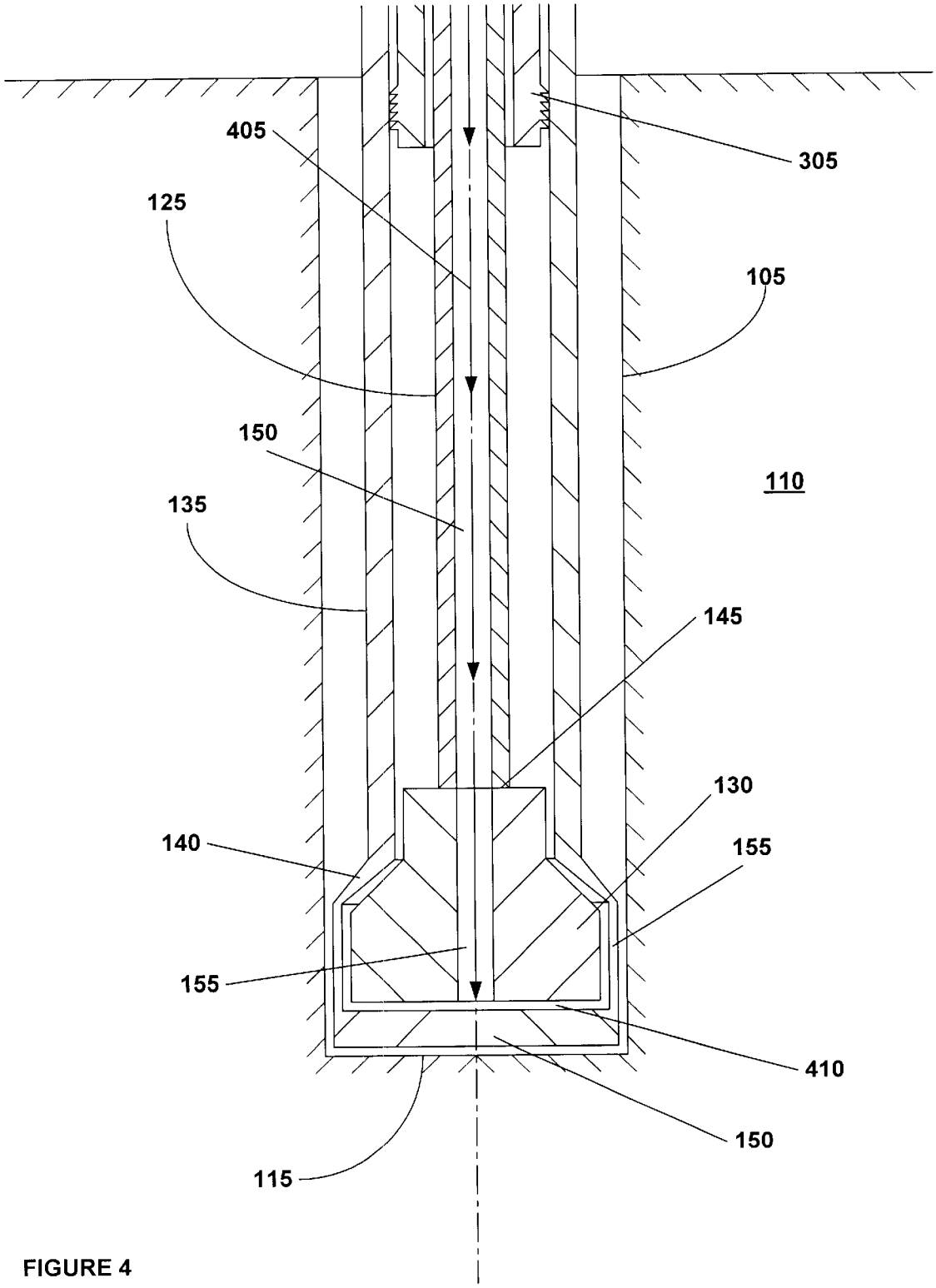
FIG. 4 is a cross-sectional view illustrating the injection of a fluidic material into the region below the mandrel of the apparatus of FIG. 3.
Figure 5:
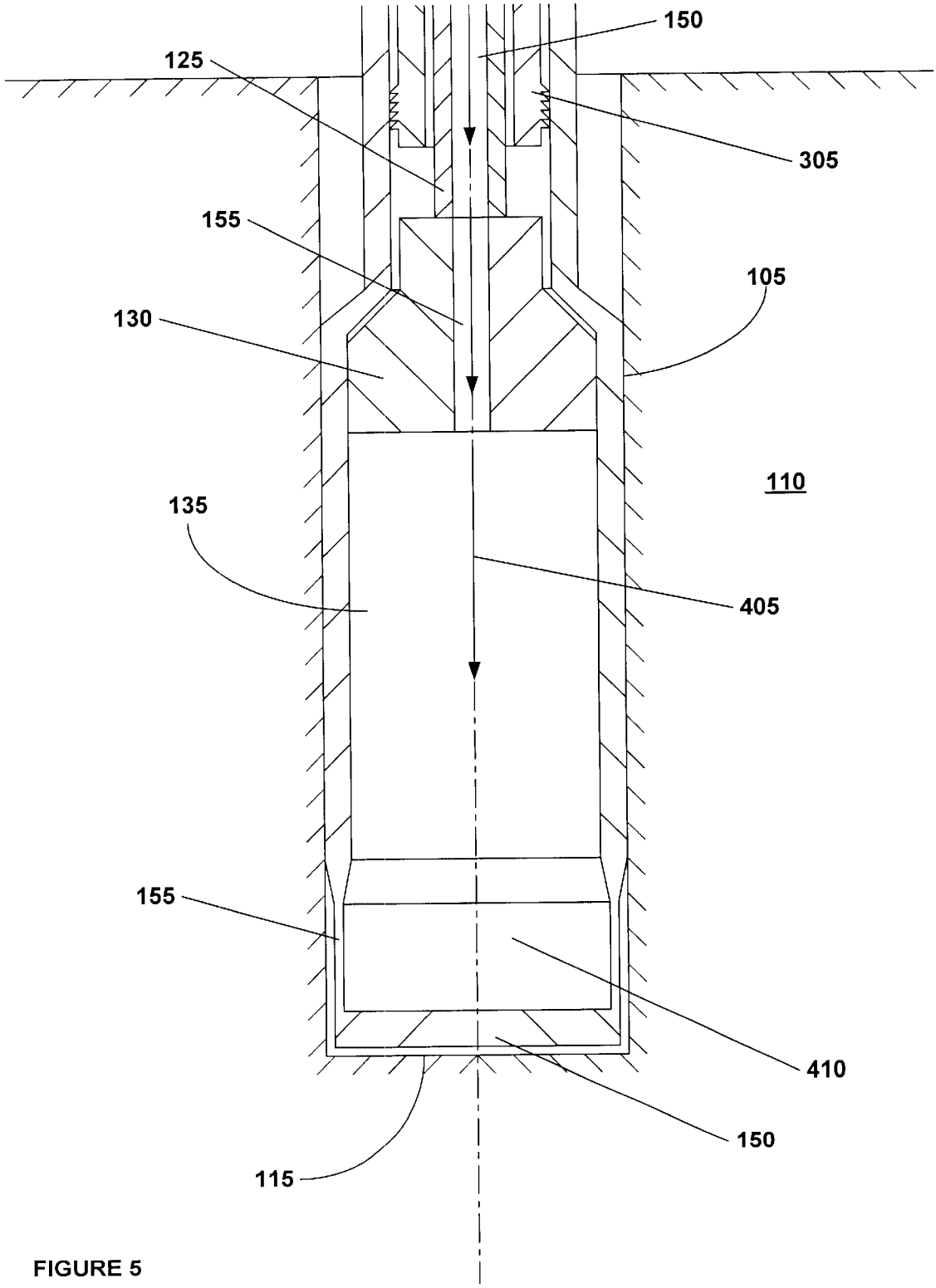
FIG. 5 is a cross-sectional view illustrating the continued injection of fluidic material into the apparatus of FIG. 4 in order to radially expand the tubular member.

As illustrated in FIG. 4, in a preferred embodiment, a fluidic material 405 is then injected into the fluid passages 150 and 155 into a chamber 410 positioned below the expansion cone 130. In a preferred embodiment, the injected fluidic material 405 causes the operating pressure within the chamber 410 it increase. In a preferred embodiment, as illustrated in FIG. 5, the increased operating pressure within the chamber 410 causes the expansion cone 130 to be axially displaced away from the bottom of the wellbore 105. In this manner, the expansion cone 130 radially expands the expandable tubular member 135. In an alternative embodiment, the expansion cone 130 is pulled out of the wellbore 105. In another alternative embodiment, the expansion cone 130 is pulled out of the wellbore 105 in conjunction with pressurizing the chamber 410.

Figure 6:
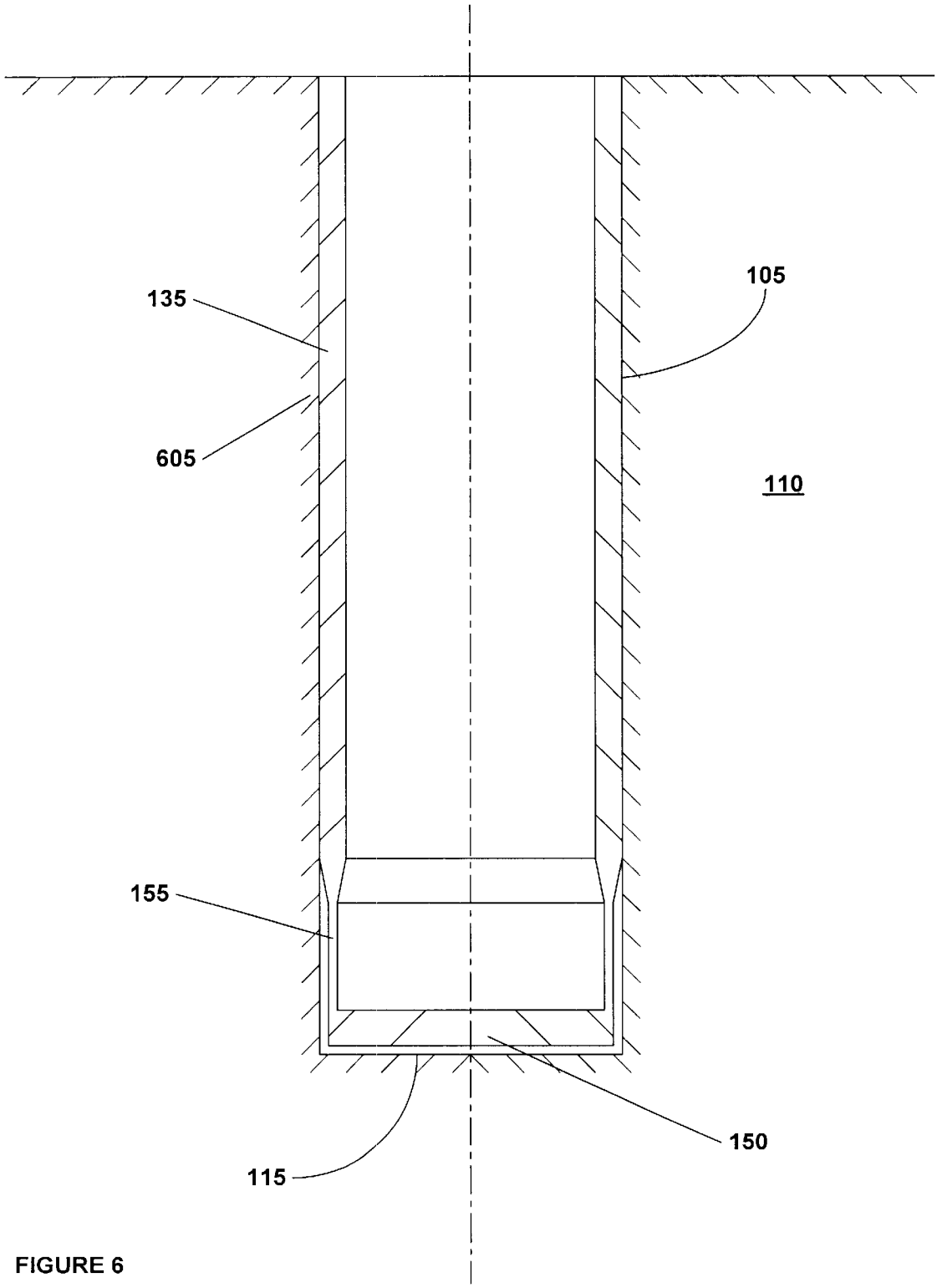
FIG. 6 is a cross-sectional view of the completed wellbore casing.
Figure 7:
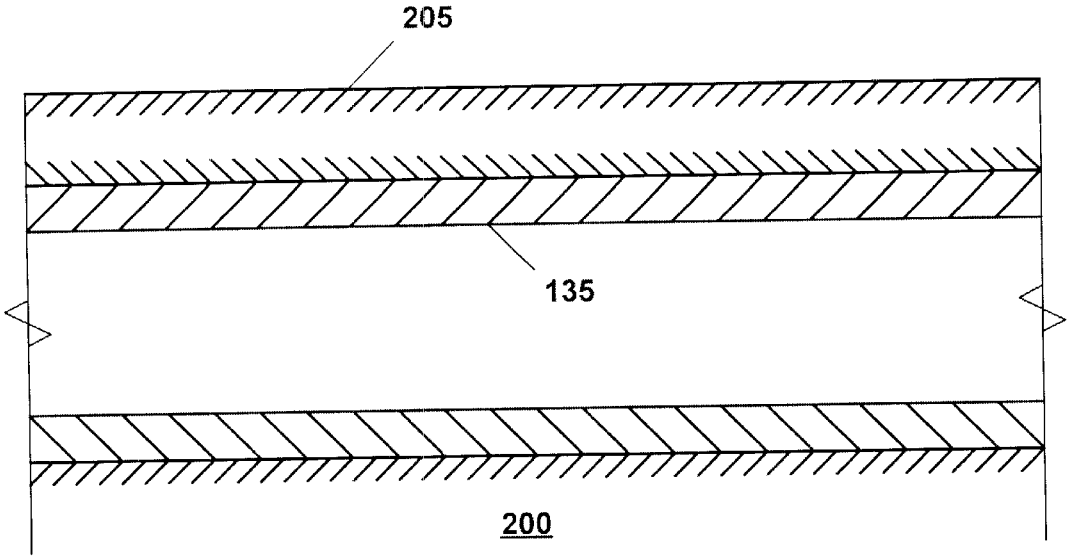
FIG. 7 is a cross sectional illustration of the use of the expanded tubular member of FIG. 6 as an underground pipeline.
Figure 8:
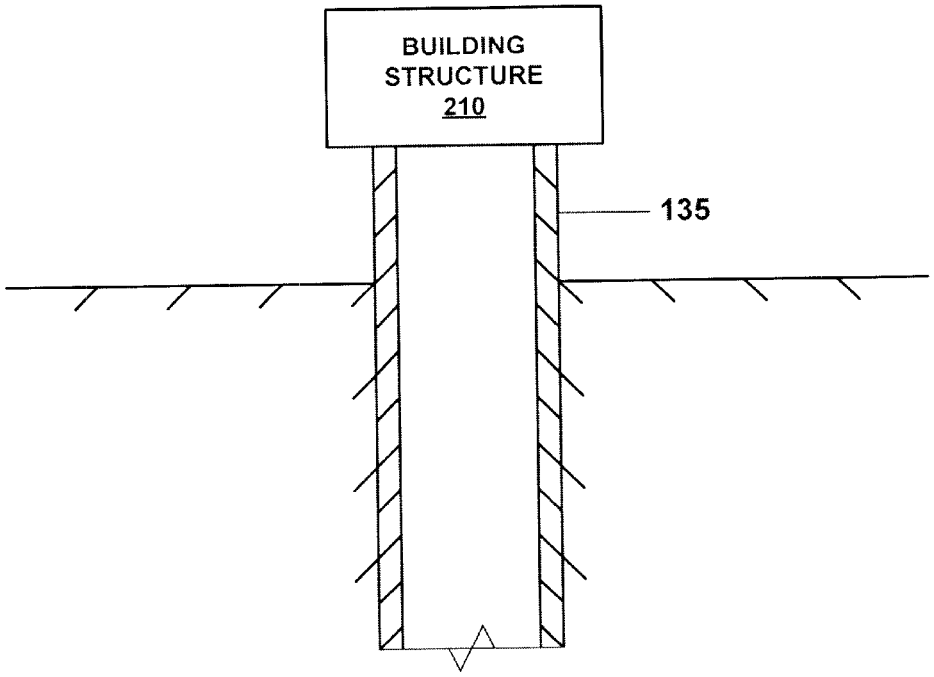
FIG. 8 is a fragmentary cross sectional illustration of the use of the expanded tubular member of FIG. 6 to provide a structural support for a building structure.

As illustrated in FIG. 6, upon completing the radial expansion process, the support member 125, expansion cone 130, and restraining device 305 are removed. The resulting expanded tubular member 135 preferably provides a wellbore casing. In an alternative embodiment, as illustrated in FIG. 7, the expanded tubular member 135 provides a pipeline that traverses a subterranean formation 200 below the surface of the earth 205. In another alternative embodiment, as illustrated in FIG. 8, the expanded tubular member 135 provides a structural support for a building structure 210. In other alternative embodiments, the at least a portion of the expandable tubular member 135 is expanded into contact with a preexisting structure such as, for example, a wellbore casing, a pipeline, or a structural support.

In a preferred embodiment, an annular region 605, within the subterranean formation 110, immediately adjacent to the expanded tubular member 135 is over stressed due to over-expansion of the expandable tubular member 135 during the radial expansion process. In this manner, the frictional forces holding the expanded tubular member 135 in place are increased thereby increasing the load carrying capacity of the expanded tubular member 135.

Figure 9:
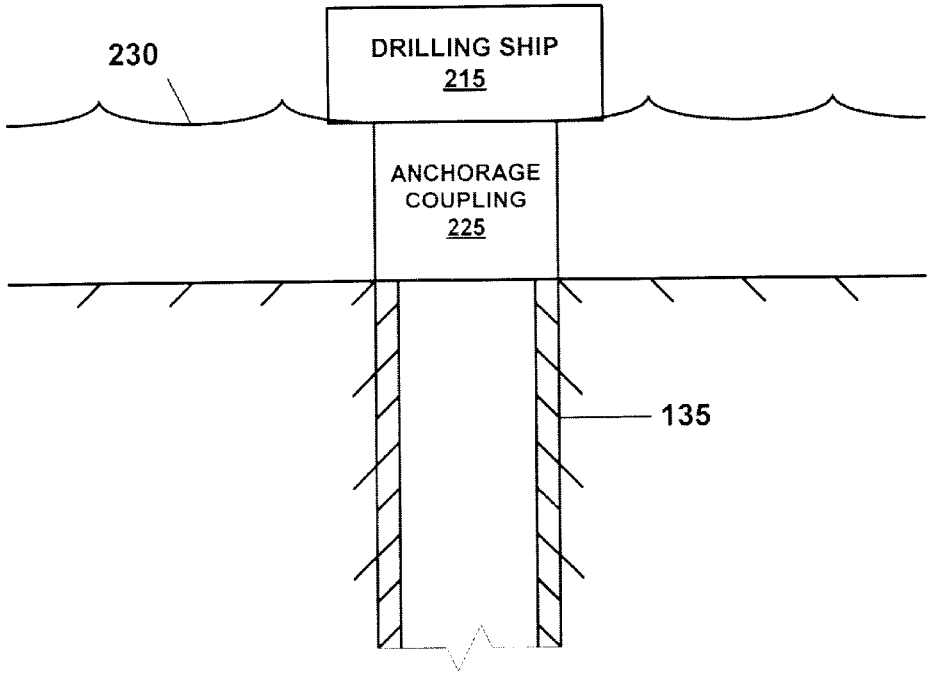
FIG. 9 is a fragmentary cross sectional illustration of the use of the expanded tubular member of FIG. 6 as an underwater anchorage for a drilling ship.
Figure 10:
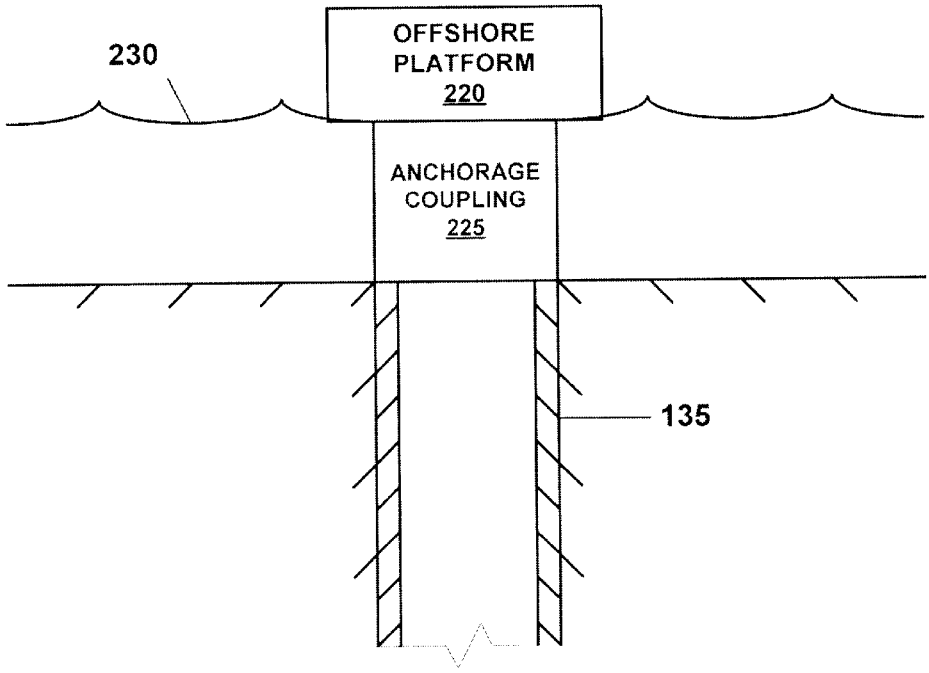
FIG. 10 is a fragmentary cross sectional illustration of the use of the expanded tubular member of FIG. 6 as an underwater anchorage for an offshore platform.

In several alternative embodiments, the fluidic material 405 includes curable cement and one or more resilient anchoring devices are at least partially embedded in the cement material. In this manner, as illustrated in FIGS. 9 and 10, the expandable tubular member 135 may be coupled to a drilling ship 215 or an offshore platform 220 by an anchorage coupling 225 that extends from the expandable tubular member to the drilling ship or offshore platform positioned on or above the surface of the water 230.

Figure 11:
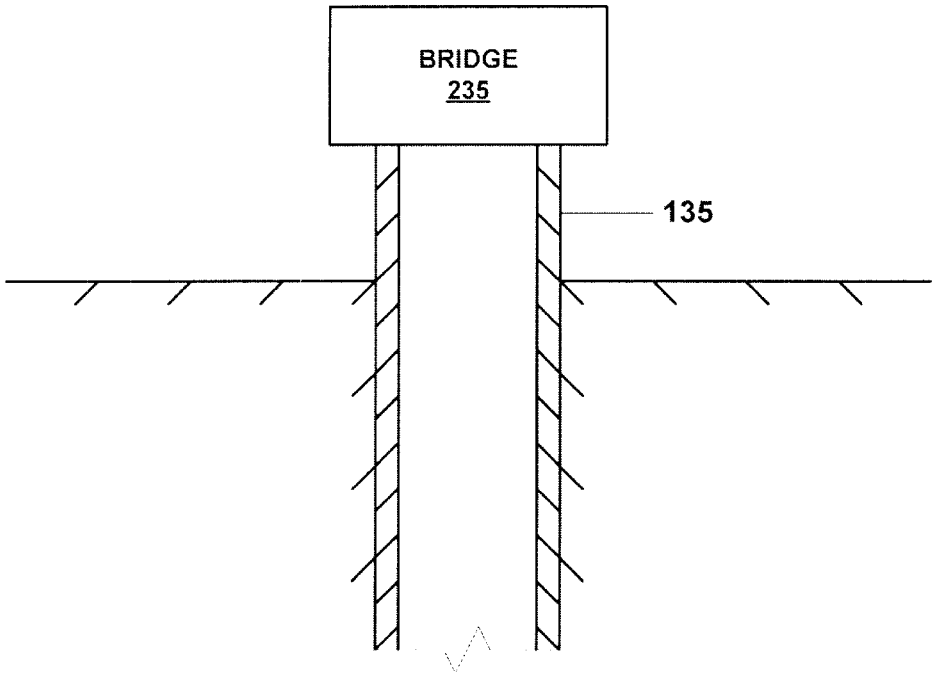
FIG. 11 is a fragmentary cross sectional illustration of the use of the expanded tubular member of FIG. 6 to provide a structural support for a bridge.
Figure 12:
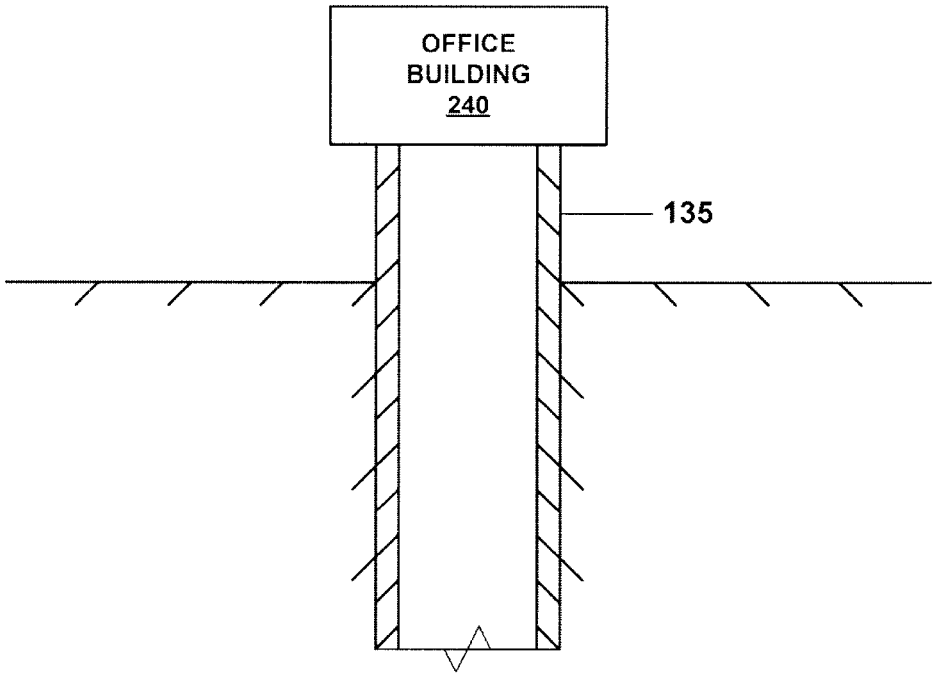
FIG. 12 is a fragmentary cross sectional illustration of the use of the expanded tubular member of FIG. 6 to provide a structural support for an office building.

In several other alternative embodiments, the fluidic material 405 includes curable cement and one or more reinforcement bars are at least partially embedded in the cement material. In this manner, as illustrated in FIGS. 11 and 12, the expanded tubular member 135 is used to provide structural pilings and supports for bridges 235, high rise office buildings 240, and other structures.

A method of driving a pipe into a subterranean formation has been described that includes driving a hole into the subterranean formation using an expansion cone. In a preferred embodiment, the driving further includes impacting the expansion cone.

A method of forming a casing in a wellbore has also been described that includes driving a hole into the bottom of the wellbore using an expansion cone and radially expanding the casing using the expansion cone. In a preferred embodiment, the driving further includes impacting the expansion cone. In a preferred embodiment, radially expanding includes pressurizing a region of the wellbore below the expansion cone. In a preferred embodiment, the casing is expanded into contact with the wellbore A method of forming a support structure in a shaft has also been described that includes driving a hole into the bottom of the shaft using an expansion cone and radially expanding the support structure using the expansion cone. In a preferred embodiment, the driving further includes impacting the expansion cone. In a preferred embodiment, the radially expanding includes pressurizing a region of the shaft below the expansion cone. In a preferred embodiment, the support structure is expanded into contact with the shaft.

A wellbore casing has also been described that includes an expanded tubular member positioned in intimate contact with the walls of a wellbore. The expanded tubular member is positioned by the process of driving a hole into the bottom of the wellbore using an expansion cone and radially expanding the tubular member using the expansion cone. In a preferred embodiment, the driving further includes impacting the expansion cone. In a preferred embodiment, the radially expanding includes pressurizing a region of the wellbore below the expansion cone.

A support structure has also been described that includes an expanded tubular member positioned in intimate contact with the walls of a shaft. The tubular expanded tubular member is positioned by the process of driving a hole into the bottom of the shaft using an expansion cone and radially expanding the tubular member using the expansion cone. In a preferred embodiment, the driving further includes impacting the expansion cone. In a preferred embodiment, the radially expanding includes pressurizing a region of the wellbore below the expansion cone.

An apparatus for driving an opening into the bottom of a shaft has also been described that includes an expansion cone adapted to radially expand a tubular member and a hammer for driving the expansion cone into the bottom of the shaft.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of forming a casing in a wellbore positioned in a subterranean formation, comprising:

driving the casing downwardly into the bottom of the wellbore using an expansion cone by impacting the expansion cone; and radially expanding the casing using the expansion cone by displacing the expansion cone upwardly relative to the casing by injecting a fluidic material into a region of the wellbore below the expansion cone.

2. The method of claim 1, wherein the casing is expanded into contact with the wellbore.

3. The method of claim 1, wherein an annular region within the subterranean formation is overstressed.

4. The method of claim 1, wherein the expansion cone defines a passage for conveying fluidic materials therethrough.

5. A method of forming a support structure in a shaft positioned within a subterranean formation, comprising:

driving the support structure downwardly into the bottom of the shaft using an expansion cone by impacting the expansion cone; and radially expanding the support structure using the expansion cone by displacing the expansion upwardly relative to the support structure by injecting a fluidic material into a region of the shaft below the expansion cone.

6. The method of claim 5, wherein the support structure is expanded into contact with the shaft.

7. The method of claim 5, wherein an annular region within the subterranean formation is overstressed.

8. The method of claim 5, wherein the expansion cone defines a passage for conveying fluidic materials therethrough.

9. A method of driving a tubular member into a subterranean formation, comprising:

movably coupling an expansion cone launcher to an expansion cone that defines a passage for conveying fluidic materials therethrough;

coupling the expansion cone launcher to an end of the tubular member;

positioning the tubular member, the expansion cone launcher, and the expansion cone proximate the subterranean formation; and impacting the expansion cone to drive the expansion cone launcher into the subterranean formation.

10. The method of claim 9, wherein the tubular member comprises a wellbore casing.

11. The method of claim 9, wherein the tubular member comprises a pipeline.

12. The method of claim 9, wherein the tubular member comprises an underwater anchorage.

13. A method of forming a support structure within a borehole positioned within a subterranean formation, comprising:

movably coupling an expansion cone launcher to an expansion cone that defines a passage for conveying fluidic materials therethrough;

coupling the expansion cone launcher to the expandable tubular member;

positioning the expandable tubular member, the expansion cone launcher, and expansion cone within the borehole;

impacting the expansion cone to drive the expansion cone launcher into the bottom of the borehole;

pressurizing a region of the expansion cone launcher below the expansion cone;

radially expanding the tubular member into contact with the walls of the borehole; and overstressing an annular region within the subterranean formation surrounding the borehole.

14. The method of claim 13, wherein the support structure comprises a wellbore casing.

15. The method of claim 13, wherein the support structure comprises a pipeline.

16. The method of claim 13, wherein the support structure comprises an underwater anchorage.

17. A method of driving a tubular member into a subterranean formation, comprising:

movably coupling an expansion cone launcher to an expansion cone that defines a passage for conveying fluidic materials therethrough;

coupling the expansion cone launcher to an end of the tubular member;

positioning the tubular member, the expansion cone launcher, and the expansion cone proximate the subterranean formation; and impacting the expansion cone to drive the expansion cone launcher into the subterranean formation;

wherein the tubular member comprises a wellbore casing.

18. A method of driving a tubular member into a subterranean formation, comprising:

movably coupling an expansion cone launcher to an expansion cone that defines a passage for conveying fluidic materials therethrough;

coupling the expansion cone launcher to an end of the tubular member;

positioning the tubular member, the expansion cone launcher, and the expansion cone proximate the subterranean formation; and impacting the expansion cone to drive the expansion cone launcher into the subterranean formation;

wherein the tubular member comprises an underwater anchorage.

19. A system for forming a casing in a wellbore positioned in a subterranean formation, comprising:

means for driving the casing downwardly into the bottom of the wellbore using an expansion cone by impacting the expansion cone; and means for radially expanding the casing using the expansion cone by displacing the expansion cone upwardly relative to the casing by injecting a fluidic material into a region of the wellbore below the expansion cone.

20. A system for forming a support structure in a shaft positioned within a subterranean formation, comprising:

means for driving the support structure downwardly into the bottom of the shaft using an expansion cone by impacting the expansion cone; and means for radially expanding the support structure using the expansion cone by displacing the expansion cone upwardly relative to the support structure by injecting a fluidic material into a region of the shaft below the expansion cone.

* * * * *

UNITED STATES PATENT AND TRADEMARK OFFICE

CERTIFICATE OF CORRECTION

PATENT NO. : 6,575,240 B1 
DATED : June 10, 2003
INVENTOR(S) : Robert Lance Cook and Richard Carl Haut It is certified that error appears in the above-identified patent and that said Letters Patent is hereby corrected as shown below:

Column 3,
Line 67, the following paragraph should be inserted
-- The expandable tubular member 135 is preferably coupled to the expansion cone launcher 140. In a preferred embodiment, the expandable tubular member 135 is adapted to be radially expanded by the axial displacement of the expansion cone 130. --

Signed and Sealed this

Twenty-first Day of October, 2003

JAMES E. ROGAN
*Director of the United States Patent and Trademark Office*